US006315744B1

(12) United States Patent
Inaba

(10) Patent No.: US 6,315,744 B1
(45) Date of Patent: Nov. 13, 2001

(54) CHAIR TYPE AIR MASSAGER

(75) Inventor: Katumi Inaba, Numazu (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/464,729

(22) Filed: Dec. 16, 1999

Related U.S. Application Data

(63) Continuation of application No. PCT/JP99/02202, filed on Apr. 26, 1999.

(30) Foreign Application Priority Data

Apr. 24, 1998 (JP) ..... 10-114774
Jun. 16, 1998 (JP) ..... 10-168218

(51) Int. Cl.[7] ..... A61H 19/00
(52) U.S. Cl. ..... 601/149; 601/148; 601/150
(58) Field of Search ..... 601/148, 149, 601/150, 151, 152, 15

(56) References Cited

U.S. PATENT DOCUMENTS 5,593,212 * 1/1997 Praria et al. ..... 601/15
5,762,618 * 6/1998 Yamanaka et al. ..... 601/151

FOREIGN PATENT DOCUMENTS 56-125228 * 9/1981 (JP) .
8-89540 * 4/1996 (JP) .
8-322895 * 12/1996 (JP) .
9-010269 1/1997 (JP) .
9-266933 10/1997 (JP) .
233477 11/1994 (TW) .
363416 7/1999 (TW) .

* cited by examiner

*Primary Examiner*—Michael A. Brown
*Assistant Examiner*—Benjamin Koo
(74) *Attorney, Agent, or Firm*—Frishauf, Holtz, Goodman, Langer & Chick, P.C.

(57) ABSTRACT

A chair type air massager includes a chair body having a seat, a back rest and a plurality of massage bags embedded therein, and a leg massage device having a pair of leg accommodating grooves and a plurality of massage bags provided in correspondence to the leg accommodating grooves. The leg massage device is capable of moving between a first position where the leg massage device is disposed in front of the seat and is connected to the chair body, and a second position where the leg massage device is separated from the chair body. The leg accommodating groove is capable of accommodating therein at least one leg of a user sitting on the seat of the chair body when the leg massage device is disposed in the first position, and the lower leg accommodating groove is capable of accommodating therein at least one leg of a user who is not sitting on the seat of the chair body when the leg massage device is in the second position. A compressed air supply/discharge device supplies and discharges compressed air to and from the plurality of massage bags of the chair body and the plurality of the massage bags of the leg massage device, thereby selectively expands and contracts these massage bags to allow the massage bags to perform massage operation.

3 Claims, 8 Drawing Sheets

CHAIR TYPE AIR MASSAGER

CROSS REFERENCE TO RELATED APPLICATIONS

This is a Continuation of Application PCT/JP99/02202, filed Apr. 26, 1999.

BACKGROUND OF THE INVENTION

The present invention relates to a chair type air massager including a leg massage device.

As shown in FIG. 11, in a conventional chair type air massager, massage bags 4 to 8 are embedded in a seat 2 and a back rest 3 of a chair body 1. A leg massage device 9 is mounted to a front end of the seat 2 of the chair body 1 such that the leg massage device 9 can vertically rotate in a predetermined range. The leg massage device 9 includes a pair of leg accommodating grooves 10 which are capable of accommodating calves of a user sitting on the seat 2. In the leg massage device 9, a leg massage bag 11 is provided on each inner side surface of each of the pair of leg accommodating grooves 10.

A handle 12 for operating a rotating motion of the leg massage device 9 is provided at one side surface of the seat 2. By operating the handle 12, the leg massage device 9 is vertically rotated at the front end of the seat 2 between a vertical position in which the leg massage device 9 extends downwards so that the leg accommodating grooves 10 are vertically extended as shown in FIG. 11, and a horizontal position in which the leg massage device 9 is extended forwards from the front end of the seat 2 in a substantially horizontal direction so that the leg accommodating grooves 10 are extended in back and fourth directions.

The leg massage device 9 of such a conventional chair type air massager is disposed in the horizontal position when it is used.

If an operation device of the chair type air massager is operated, compressed air is supplied to or discharged from the massage bags 4 to 8 and 11 by an air supply/discharge device (not shown) provided in the seat 2. These massage bags 4 to 8 and 11 are repeatedly expanded and contracted, thereby massaging portions of the sitting user corresponding to the massage bags 4 to 8 and 11.

When the leg massage device 9 is not used, the leg massage device 9 is disposed in the vertical position shown in FIG. 11. By the above-described operation device, it is possible to select the massage bags 4 to 8 and 11 to and from which the compressed air is supplied and discharged, and to select the time interval during which the compressed air is supplied to and discharged from the selected massage bag or bags.

As described above, the leg massage device 9 includes three side walls at opposite sides of the pair of leg accommodating grooves 10 and between them. Therefore, when the leg massage device 9 is disposed in the vertical position for using only the massage bags 4 to 8 of the chair body 1 without using the leg massage device 9, the sitting user is forced to locate his or her calves along the pair of leg accommodating grooves 10 of the leg massaging device 9 in the vertical position. This is because, if the calves are not located in this manner, the calves of the sitting user abut against the three side walls of the leg massage device 9 which project forwards from an under region of the seat 2, so that the user feels unpleasant. Therefore, the sitting user who is forced to locate his or her calves as described above can not sufficiently relax when the leg massage device 9 is not used.

Further, the massage bag 11 in the leg massage device 9 rotatably mounted to the front end of the seat 2 can not be moved along a longitudinal direction of the leg accommodating groove 10 corresponding to the massage bag 11. Therefore, when the leg massage device 9 is used, only longitudinally intermediate portions of the calves of the sitting user are massaged, and it is difficult to massage ankle portions or thigh portions of the legs of the sitting user.

The present invention has been derived from the above-described circumstances, and an object of the present invention is to provide a chair type air massager in which a leg massage device can be disposed without hindering the calves of a sitting user and whose leg massaging device can be used without requiring of the user to sit on the chair body.

BRIEF SUMMARY OF THE INVENTION

To achieve the above-described object of the present invention, a chair type air massager of the present invention comprises:

a chair body including a seat, a back rest and a plurality of massage bags embedded therein;

a leg massage device including at least one leg accommodating groove and at least one massage bag provided in correspondence to the at least one leg accommodating groove, the leg massage device being capable of moving between a first position where the leg massage device is disposed in front of the seat and is connected to the chair body, and a second position where the leg massage device is separated from the chair body, the leg accommodating groove being capable of accommodating therein at least one leg of a user sitting on the seat of the chair body when the leg massage device is disposed in the first position, and the leg accommodating groove being capable of accommodating therein at least one leg of a user who is not sitting on the seat of the chair body when the leg massage device is in the second position; and a compressed air supply/discharge device for supplying and discharging compressed air to and from the plurality of massage bags of the chair body and the at least one massage bag of the leg massage device.

In the chair type air massager according to the present invention constructed in the above-described manner, the leg massage device is capable of moving between the first position where the leg massage device is disposed in front of the seat and is connected to the chair body, and the second position where the leg massage device is separated from the chair body. The leg accommodating groove is capable of accommodating therein at least one leg of a user sitting on the seat of the chair body when the leg massage device is disposed in the first position, and the leg accommodating groove is capable of accommodating therein at least one leg of a user who is not sitting on the seat of the chair body when the leg massage device is in the second position.

Therefore, in the chair type air massager according to the present invention, when the leg massage device is not used and only the plurality of the massage bags of the chair body are used to massage the body of the user sitting on the chair body, the leg massage device can be disposed in the second position separated from the chair body. The leg massage device disposed in the second position does not hinder the calves of the sitting user.

Further, in the chair type air massager of the present invention, at least one leg of a user who is not sitting on the seat of the chair body can be accommodated in the leg accommodating groove disposed in the second position.

Therefore, the leg massage device can be utilized even if the user does not sit on the chair body, and an arbitrary portion of the leg of the user of the leg massage device can be massaged by the massage bag of the leg massage device.

In the chair type air massager of the present invention characterized in the above-described manner, the leg massage device is preferably provided with a pair of leg accommodating grooves which are substantially parallel to each other, and a plurality of massage bags are preferably provided in correspondence to each of the plurality of leg accommodating grooves.

In the chair type air massager of the present invention characterized in the above-described manner, the air supply/discharge device is preferably provided in the chair body, and the chair type air massager further comprises a high pressurized air transmitting tube having one end detachably connected to the air supply/discharge device and the other end extending from the one end to outside of the chair body and connected to at least one massage bag of the leg massage device.

Such an air supply/discharge device can commonly act on the plurality of massage bags of the chair body and the at least one massage bag of the leg massage device. Therefore, a structure of the chair type air massager according to the present invention using the air supply/discharge device becomes simple.

In the chair type air massager of the present invention characterized in the above-described manner, it is preferable that a space for accommodating the leg massage device is provided under the seat, the space constitutes a third position for the leg massage device.

Such a leg massage device accommodating space ensures a neat and smart storage of the leg massage device when it is not used, and ensures a swift preparation for using the leg massage device when the leg massage device is used.

It is preferable that the chair type air massager of the present invention characterized in the above-described manner further comprises: a supporting member which is movable between a projecting position where the supporting member is projected forwards from the seat and a retracted position where the supporting member is retracted under the seat; a leg supporting table provided on the supporting member; a connecting member provided on the leg supporting table; and an engaging member provided on the leg massage device, the engaging member detachably engaging with the connecting member while the supporting member is disposed in the projecting position, thereby disposing the leg massage device in the first position.

With such a structure, a structure for detachably connecting the leg massage device to the chair body becomes simple, and the movement of the leg massage device between the first and second positions becomes easy.

In such a structure, it is preferable that the connecting member includes a guide surface; and the engaging member includes a guided surface whose movement is guided along the guiding surface of the connecting member when the engaging member engages with the connecting member.

Such a structure facilitates the engaging operation of the engaging member with respect to the connecting member, and further facilitates the disposing operation of the leg massage device to the first position.

It is preferable that the leg supporting table is supported on the supporting member to be movable in a longitudinal direction.

Such a structure permits the leg massage device to move along the longitudinal direction of the leg accommodating groove when the leg massage device is used in the first position. Therefore, even when the leg massage device is disposed in the first position and at least one leg of sitting user is accommodated in at least one leg accommodating groove in the leg massage device, an arbitrary portion of the at least one leg of the sitting user can be sufficiently effectively massaged by the at least one massage bag of the leg massage device.

In the above-described structure, it is preferable that the engaging member is provided on the leg massage device at a position separated from a center position of the leg massage device in a direction along a longitudinal direction of the leg accommodating groove. In such a structure, while the engaging member of the leg massage device engages with the connecting member of the supporting member, if the leg massage device is moved to separate from the connecting member around an end of the leg massage device at which the engaging member is disposed, the engagement of the engaging member with the connecting member is released by a so-called lever action. That is, even if the engaging strength of the engaging member of the leg massage device with the connecting member of the supporting member is increased, it is possible to engage the engaging member with the connecting member easier although the structure is simple.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

Figure 1:
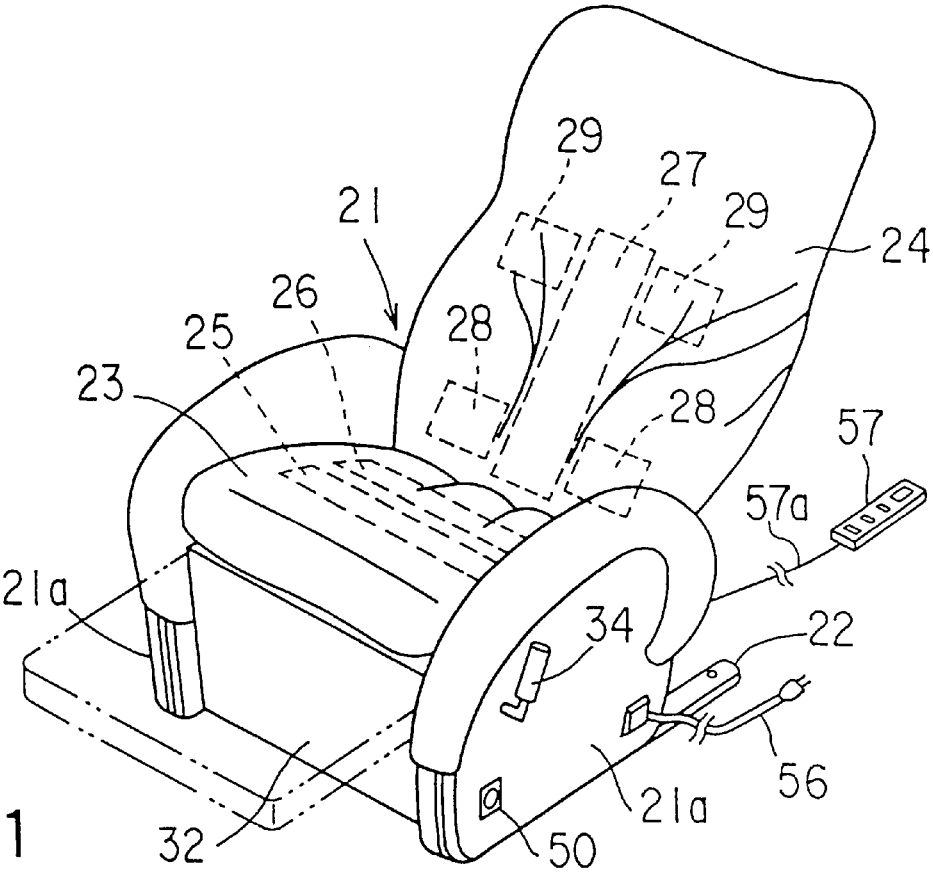
FIG. 1 is a schematic perspective view of a chair type air massager according to a first embodiment of the present invention.

Chair type air massagers according to various embodiments of the present invention will be explained in detail with reference to the accompanying drawings below.

DETAILED DESCRIPTION OF THE INVENTION

A first embodiment of the present invention will be explained with reference to FIGS. 1 to 5 below.

In each of the figures, a reference numeral 21 denotes a chair body. The chair body 21 includes a seat 23 mounted to a body frame 22, and a back rest 24 disposed such as to extend obliquely rearwards and upwards from a rear end of the seat 23. The back rest 24 may be provided to the seat 23 in such a manner that an angle of the back rest 24 to the seat 23 can be adjusted through a reclining mechanism (not shown) or in such a manner that the back rest 24 is fixed. The chair body 21 also includes a pair of side plates 21*a* mounted to the body frame 22 so that the side plates 21 are located at both left and right sides of the seat 23.

An upper end of each of the pair of side plates 21*a* functions as an arm rest.

A thigh massage bag 25 and a buttocks massage bag 26 as main massage bags are embedded in the seat 23 to make a space therebetween in back and forth directions of the seat 23. Each of the thigh massage bag 25 and the buttocks massage bag 26 extends in a lateral direction of the seat 23. A plurality of main massage bags are embedded in the back rest 24. In this embodiment, the plurality of main massage bags include a center back massage bag 27 extending in a vertical direction at a center in a widthwise direction of the back rest 23, a pair of lower back massage bags 28 disposed at both left and right sides of the center back massage bag 27 and at lower parts of the back rest 23, and a pair of shoulder massage bags 29 disposed at both left and right sides of the center back massage bag 27 and at upper parts of the back rest 23.

Figure 2:
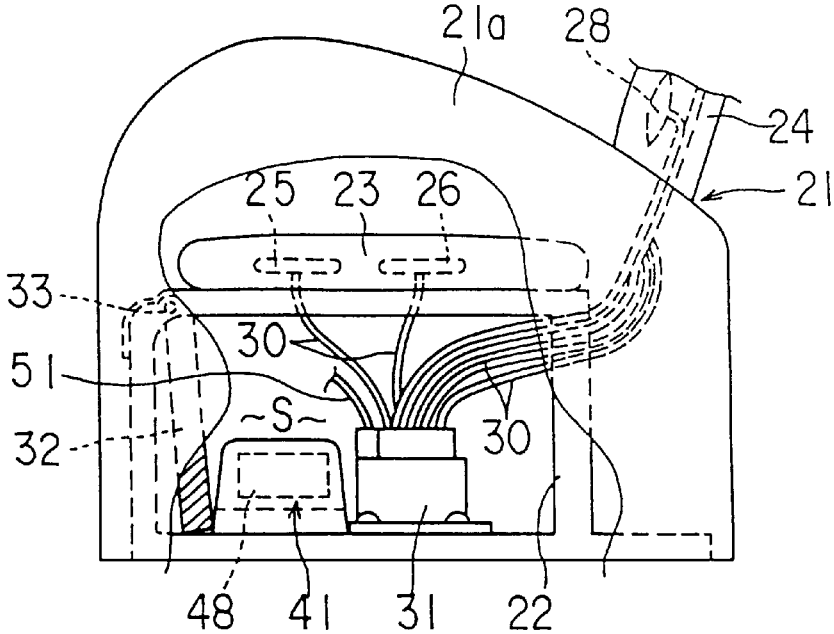
FIG. 2 is a side view of a main portion of the chair type air massager shown in FIG. 1, wherein a part of the main portion is cut away to show schematically an inside structure of the main portion.

As shown in FIG. 2, a compressed air supply/discharge device 31 is disposed in a space surrounded by the seat 23 and the pair of side plates 21*a*. This device 31 includes an air compressor, a surge tank for temporarily storing the compressed air discharged from the compressor, a rotary type air supply/discharge vale connected to the surge tank and connected to the massage bags 25 to 29 through a flexible tube 30, and a main controller for controlling an operation of each of the compressor and the air supply/discharge valve. The rotary type air supply/discharge valve is controlled by the main controller to distribute the compressed air in the surge tank to the massage bags 25 to 29 simultaneously or in a predetermined order, and to discharge the compressed air from the massage bags 25 to 29 simultaneously or in a predetermined order. The main controller can select the massage bag or bags in the massage bags 25 to 29, to and from which the supply or discharge of the compressed air is carried out, and can arbitrary change the order to supply or discharge the compressed air to or from the selected massage bags. In accordance with the supply or discharge of the compressed air to and from the massage bags 25 to 29 by this device 31, the massage bags 25 to 29 repeat its expansion and contraction in a designated order, so that portions of a body of a sitting user sitting on the chair body 21 corresponding to the massage bags 25 to 29, are pressed and relaxed, and these portions of the body are air massaged.

A leg supporting table 32 is mounted to a front portion of the body frame 22 such that the leg supporting table 32 can rotate in a predetermined range in the vertical direction through a pivot shaft 33 (see FIG. 2). The leg supporting table 32 can rotate between a horizontal in-use position where the leg supporting table 32 project forwards from a front edge of the seat 23 to take a substantially horizontal attitude (shown with a tow-dots chain line in FIG. 1, and with a solid line in each of FIGS. 3 to 5), and a vertically non-use position where the leg supporting table 32 is folded downwards between the pair of side plates 21*a* from the front edge of the seat 23 (shown with a solid line in FIG. 1, and with a broken line in 2). Further, the leg supporting table 32 can be selectively held in the horizontal in-use position, and the vertical non-use position and preferably the leg supporting table 32 can be selectively held at an arbitrary angle between the horizontal in-use position and the vertical non-use position.

The above described rotation and position holding of the leg supporting table 32 is performed by an operation handle 34 projected from an outer side surface of one of the side plates 21*a*.

Figure 3:
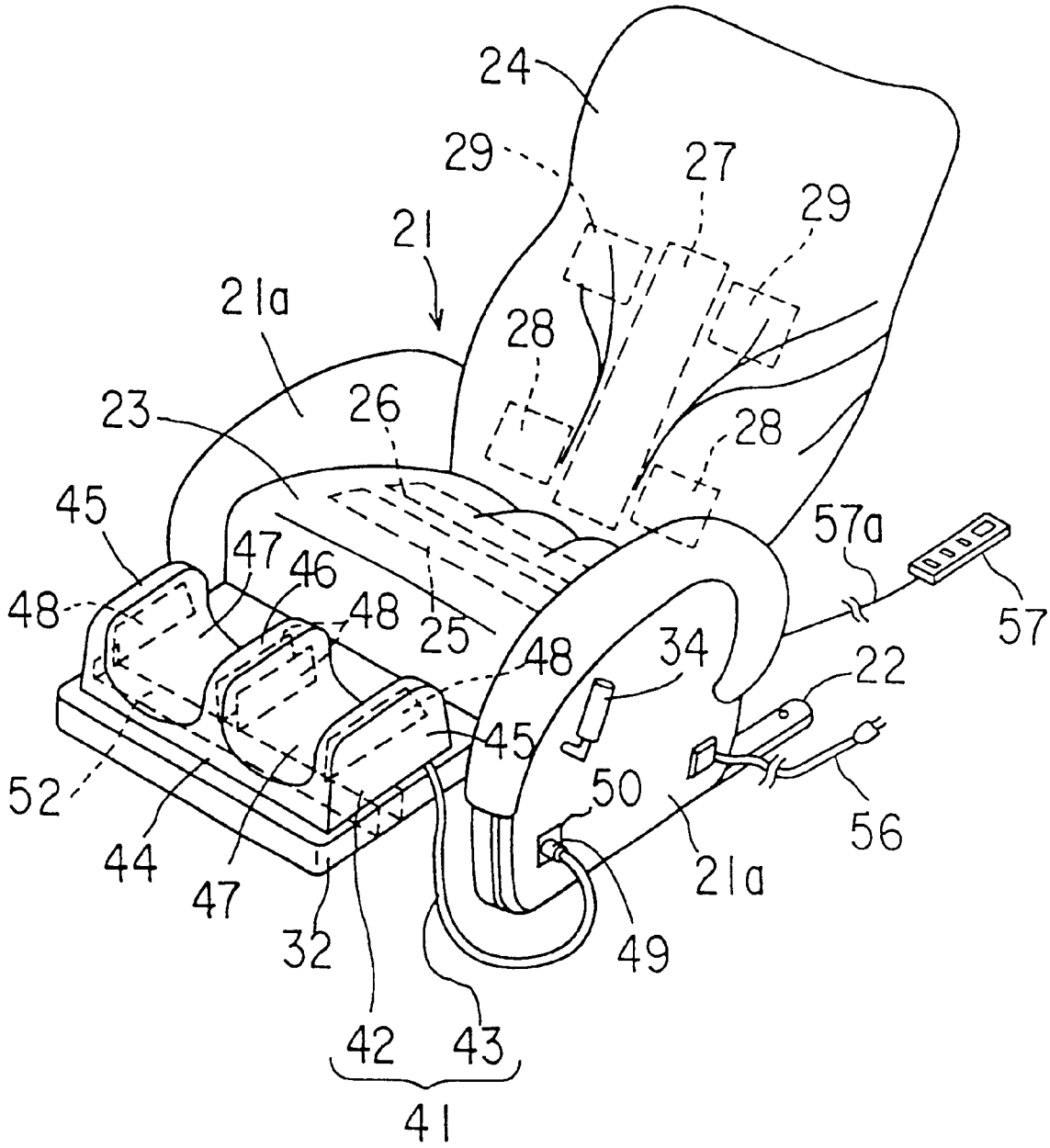
FIG. 3 is a perspective view schematically showing the chair type air massager shown in FIG. 1 in a first using mode.
Figure 4:
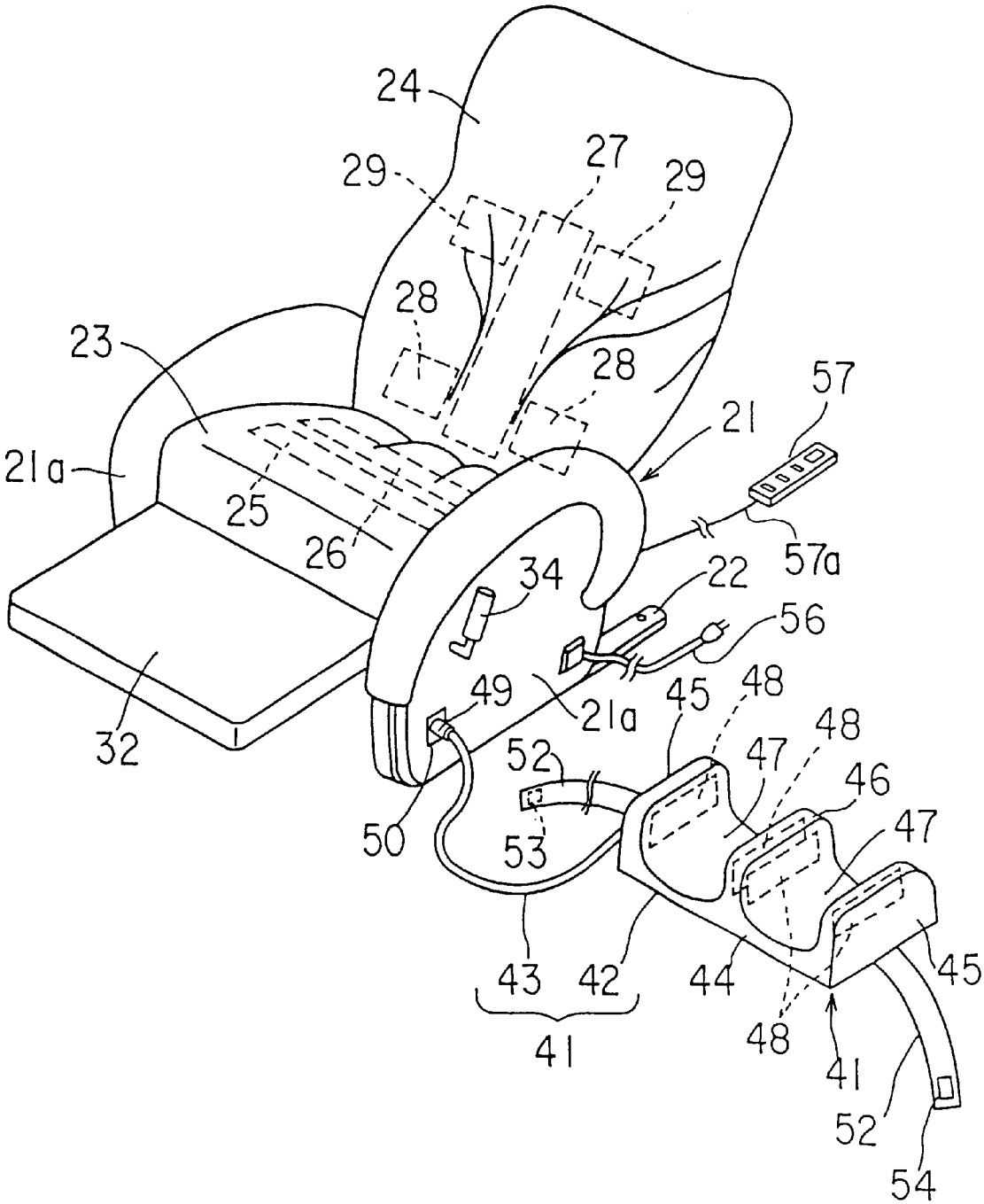
FIG. 4 is a perspective view schematically showing the chair type air massager shown in FIG. 1 in a second using mode.

As shown in FIGS. 2 to 4, a leg massage device 41 is detachable to the leg supporting table 32 of the chair body 21. The leg massage device 41 includes a device body 42 and a flexible air tube 43 connected thereto. The device body 42 includes a base 44 on an upper surface of which a pair of side walls 45 and a center wall 46 are provided. Leg accommodating grooves 47 whose upper end and back and fourth ends are opened are formed between the side walls 45 and the center wall 46. The side walls 45 and the center wall 46 are provided with a plurality of leg massage bags 48 each corresponding to each of opposite side surfaces of each of the pair of accommodating grooves 47. The massage bags 48 may be embedded in the side walls 45 and the center wall 46, or may be exposed on the side surfaces of the pair of accommodating grooves 47. Each of the massage bags 48 is in communication with the air tube 43 through tubes (not shown) in the base 44, and an expansion and contraction of each of the massage bags 48 is controlled by the compressed air supply/discharge device 31 in the chair body 21.

In the air tube 43, a tip end thereof closer to the chair body 21 has a mouthpiece 49. The mouthpiece 49 is detachably connected to a connector 50 disposed on an outer side surface of one of the side plates 21*a* of the chair body 22. A tube 51 (see FIG. 2) leading out from the compressed air supply/discharge device 31 is connected to the connector 50. Therefore, as the compressed air supply/discharge device 31 is operated, the compressed air is supplied to or discharged from the leg massage bag 48 through the tube 51, the connector 50, the air tube 43 and a tube (not shown) in the base 44. In a state where the air tube 43 is connected to the connecting portion 50. The air tube 43 has a sufficient length to allow a movement of the device body 42 among a first position where the device body 42 is disposed on the leg supporting table 32 disposed forwards to the seat 23 as shown in FIG. 3, a second position where the device body 42 is separated from the chair body 21 and is disposed around the chair body 21 as shown in FIG. 4, and a third position where the device body 42 is disposed in a space under the seat 23 as shown in FIG. 2.

As shown in FIG. 4, mounting means, for example two fastening belts 52, are mounted to a bottom surface of the device body 42 to mount the device body 42 to the leg supporting table 32. Tip ends of these belts 52 includes flat fasteners 53 and 54, respectively. When the device body 42 is mounted onto the leg supporting table 32, the belts 52 are folded toward a back of the supporting table 32 and the flat fasteners 53 and 54 on the tip ends thereof are superposed on and coupled to each other, thereby mounting the device body 42 onto the leg supporting table 32. This coupling is released by pulling off of the flat fasteners 53 and 54 from each other, so that the device body 42 can be removed from the leg supporting table 32. Therefore, these belts 52 and the leg supporting table 32 constitute disposing means for disposing the device body 42 of the leg massage device 41 at the front side of the seat 23.

In the space surrounded by the seat 23 and the pair of side plates 21*a*, a region located in front of the compressed air supply/discharge device 31 serves as a storing region S (FIG. 2) for accommodating the device body 42 together with the air tube 43. The device body 42 together with the air tube 43 can be brought out from and into the storing region S through a front side of the chair body 21 while the leg supporting table 32 is disposed in the horizontal in-use position.

In each of the figures, excepting FIG. 2, the reference numeral 56 designates a power cord connected to the compressed air supply/discharge device 31, and the reference numeral 57 denotes a remote controller. The remote controller 57 is connected to the compressed air supply/discharge device 31 through a control cable 57*a*, and a user of this char type air massager can set a desired massage mode in the main controller of the compressed air supply/discharge device 31 through the controller 57.

Figure 5:
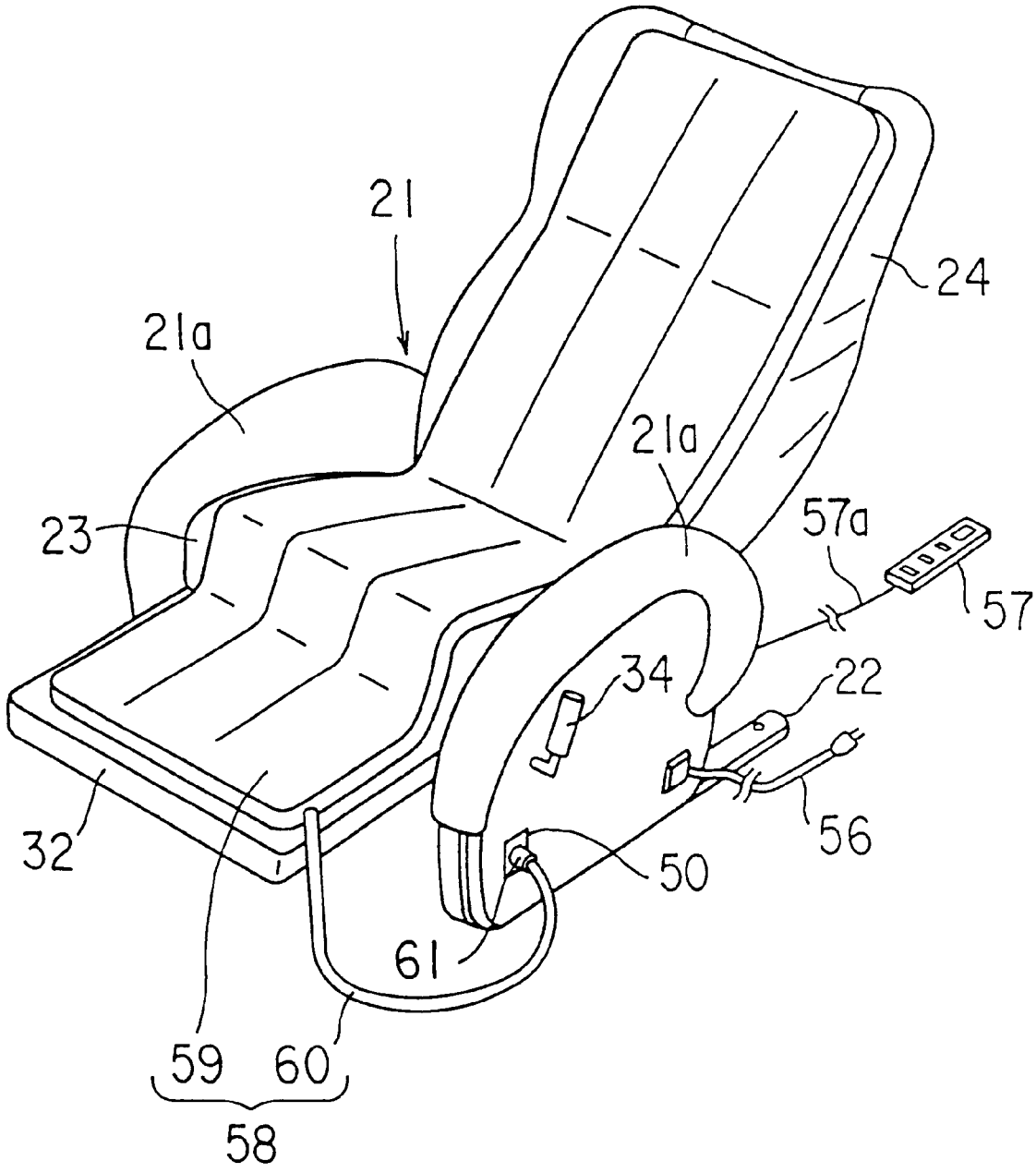
FIG. 5 is a perspective view schematically showing the chair type air massager shown in FIG. 1 in a third using mode.

In FIG. 5, the reference numeral 58 denotes an air mat which is used as required. The air mat 58 includes a mat body 59 to be disposed on upper surfaces of the seat 23 and the back rest 24 of the chair body 21 as well as on an upper surface of the leg supporting table 32 in its horizontal in-use position while the leg supporting table 32 is disposed in its horizontal in-use position and the leg massage device 41 is disposed in the second position or the third position. A mouthpiece 61 is mounted to a tip end of the air tube 60, and the mouthpiece 61 is attachable to and detachable from the connector 50 on the outer side surface of one of the side walls 21*a* of the chair body 21.

A standard using mode (first using mode) of the chair type air massager of this embodiment is shown in FIG. 3. In the standard using mode, the leg massage device 41 is mounted onto the upper surface of the leg supporting table 32 disposed in its using position through the belts 52, and the air tube 43 is connected to the connector 50 on the outer side surface of one of the side walls 21*a*. A user sitting on the chair type air massager places his or her calves into the pair of leg accommodating grooves 47 of the leg massage device 41 and then, operates the remote controller 57. As a result, the compressed air supply/discharge device 31 selectively expands and contracts the massage bags 25 to 29 and 48 in accordance with the massage mode set in the main controller through the remote controller 57, thereby air massaging the body of the sitting user.

FIG. 4 shows the second using mode. In the second using mode, the leg massage device 41 is detached from the leg supporting table 32 and is placed on a floor near the chair body 21, but the air tube 43 is still connected to the connector 50 of the chair body 21. The user lies down on the floor, and places his or her calves into the pair of leg accommodating grooves 47 of the leg massage device 41 placed on the floor. The user can selectively expands and contracts only the massage bag 48 of the leg massage device 41 by operating the remote controller 57, so that the calves of the user can be air massaged.

In the second using mode, another user can also sit on the chair body 21. In this case, the massage bags 25 to 29 in the chair body 21 can also be selectively expanded and contracted by operating the remote controller 57. Therefore, the calves of the user lying down on the floor and portions of a body other than the calves of the other user sitting on the chair body 21 can be air massaged simultaneously. The leg supporting table 32 can be disposed in the vertical non-use position.

As described above, the chair type air massager according to the first embodiment can be selectively used in either the first using mode shown in FIG. 3 or the second using mode shown in FIG. 4.

Further, as shown in FIG. 5, instead of the leg massaging device 41, the air mat 58 may be used in combination with the chair body 21. When the air mat 58 is used, it is possible to operate the compressed air supply/discharge device 31 in a mode in which the supply and discharge of the compressed air only to and from the mat 58 are repeated, by operating the remote controller 57. In this mat operating mode, the compressed air supply/discharge device 31 works so that an interval between the supply and the discharge of the compressed air to and from the air mat 58 is set long and the air mat 58 is expanded and contracted in slow rhythm. As a result, the sitting user can feel as if he or she is gently embraced on the air mat 58, and can sufficiently relax. The air mat 58 can be separated from the chair body 21 and can be used instead of the leg massage device 41. In this case, the air mat 58 is connected to the chair body 21 through the air tube 60. In this case also, another user other than a user using the air mat 58 can sit on the chair body 21 and can be air massaged by the chair body 21.

When the chair type air massager is not used or the leg massage device 41 is not used, the leg massage device 41 can be stored in the above-described storing region S in the interior space surrounded by the seat 23 and the pair of side walls 21*a* in the chair body 21 as shown in FIG. 2.

At that time, wherever the user sitting on the chair body 21 may place his or her calves, the calves are not in contact with the leg massage device 41, and the user can sufficiently relax and sit on the chair body 21.

By disposing the leg supporting table 32 in the vertical position, the front opening of the storing region S is covered with the leg supporting table 32. Therefore, an outer appearance of the chair type air massage when it is not used or the leg massaging device 41 is not used is improved.

The present invention should not be limited to the first embodiment. For example, the leg supporting table 32 can be omitted, and the leg massage device 41 can be detachably mounted directly to the front portion of the body frame 22 using a fixing screw for example.

Further, the air tubes 43 and 60 for attachments such as the leg massage device 41 and the air mat 58 can be omitted, and while the connector 50 is provided on the exit of each of the tubes of the leg massage device 41 and the air mat 58, a common air tube for the attachments such as the leg massage device 41 and the air mat 58 can be extended from the compressed air supply/discharge device 31 of the chair body 21, and the mouthpiece 49 which is detachably connected to the connector 50 can be provided on the tip end of the air tube.

Next, a second embodiment of the present invention will be explained with reference to FIGS. 6 to 10. The second embodiment is different from the first embodiment in a detachable coupling structure between a leg supporting table 130 and a leg massage device 140, and in a mounting structure of the leg supporting table 130 with respect to the chair body. In the second embodiment, structural elements similar to those in the first embodiment are designated with the same reference numerals as those used to designate the same structural elements in the first embodiment, and detailed description of these structural elements will be omitted.

Figure 6:
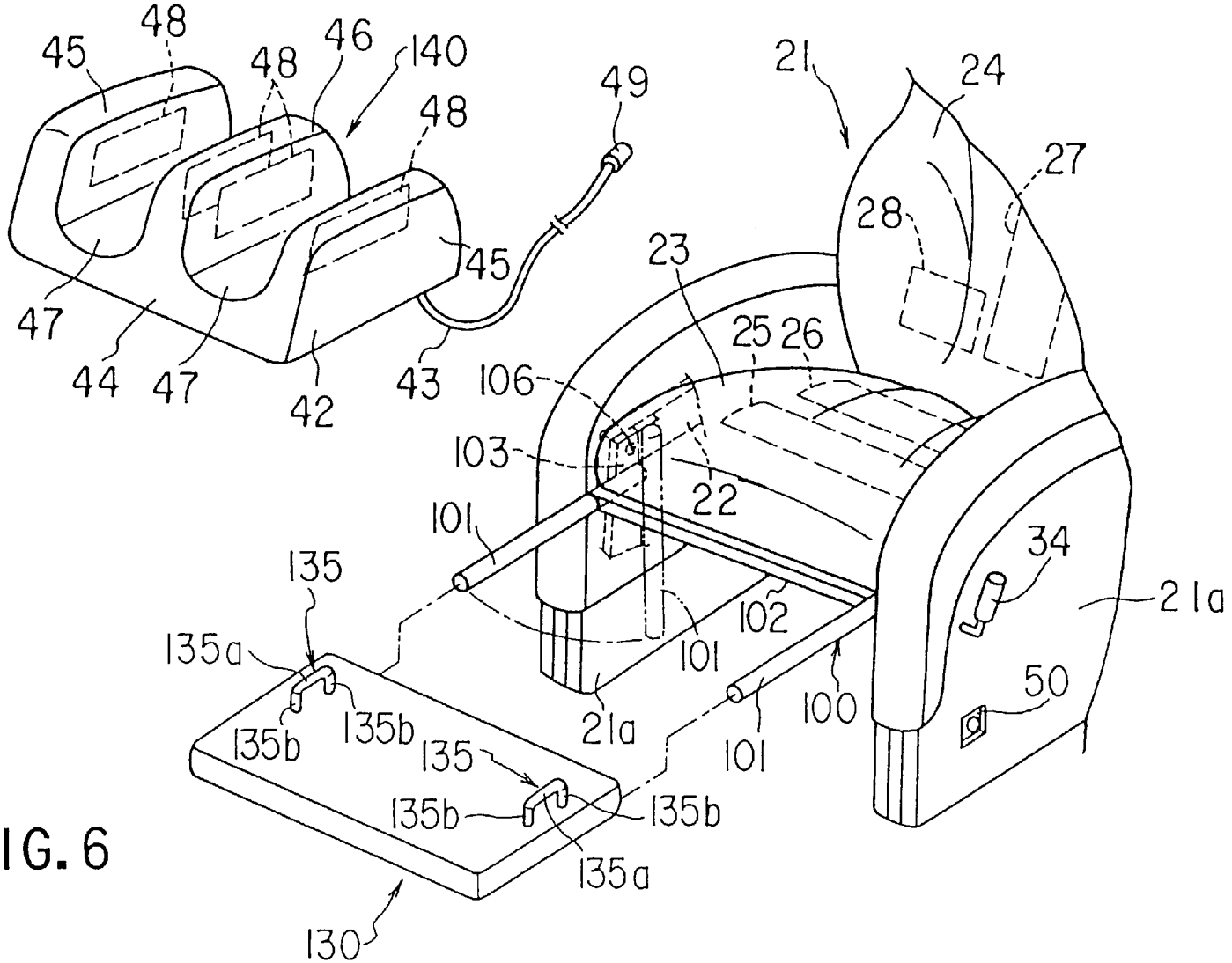
FIG. 6 is an exploded perspective view schematically showing a structure of a main portion of a chair type air massager according to a second embodiment of the invention.

As shown in FIG. 6, a supporting member 100 is rotatably mounted to the body frame 22 through pivot shafts 106 at the front end of the seat 23. The supporting member 100 includes a pair of supporting rods 101 disposed in parallel to each other and directed to the same direction, and a connecting member 102 connecting the base end portions of these supporting rods 101 to each other. A bearing 103 is fixed to the base end portion of each of the supporting rods 101.

By fitting the pivot shafts 106 of the body frame 22 to bearing holes of each of the bearings 103, the supporting member 100 is vertically rotatably mounted to the body frame 22.

The supporting member 100 is vertically rotatably between a horizontal in-use position where the supporting member 100 projects substantially horizontally forward from the seat 23 as shown with a solid line in FIG. 6, and a vertically non-use position where the supporting member 100 is folded downwards from the front edge of the seat 23 as shown with a tow-dots chain line in FIG. 6.

As in the first embodiment, the supporting member 100 is rotated between the horizontal in-use position and the vertical non-use position by operating the operating handle 34 on an outer side surface of one of the side walls 21*a* of the chair body 21, and the supporting member 100 can be selectively held in any of these positions. More preferably, the supporting member 100 can be held at an arbitrary angle between these positions.

Next, the leg supporting table 130 mounted to be movable to the supporting member 100 will be explained.

Figure 7:
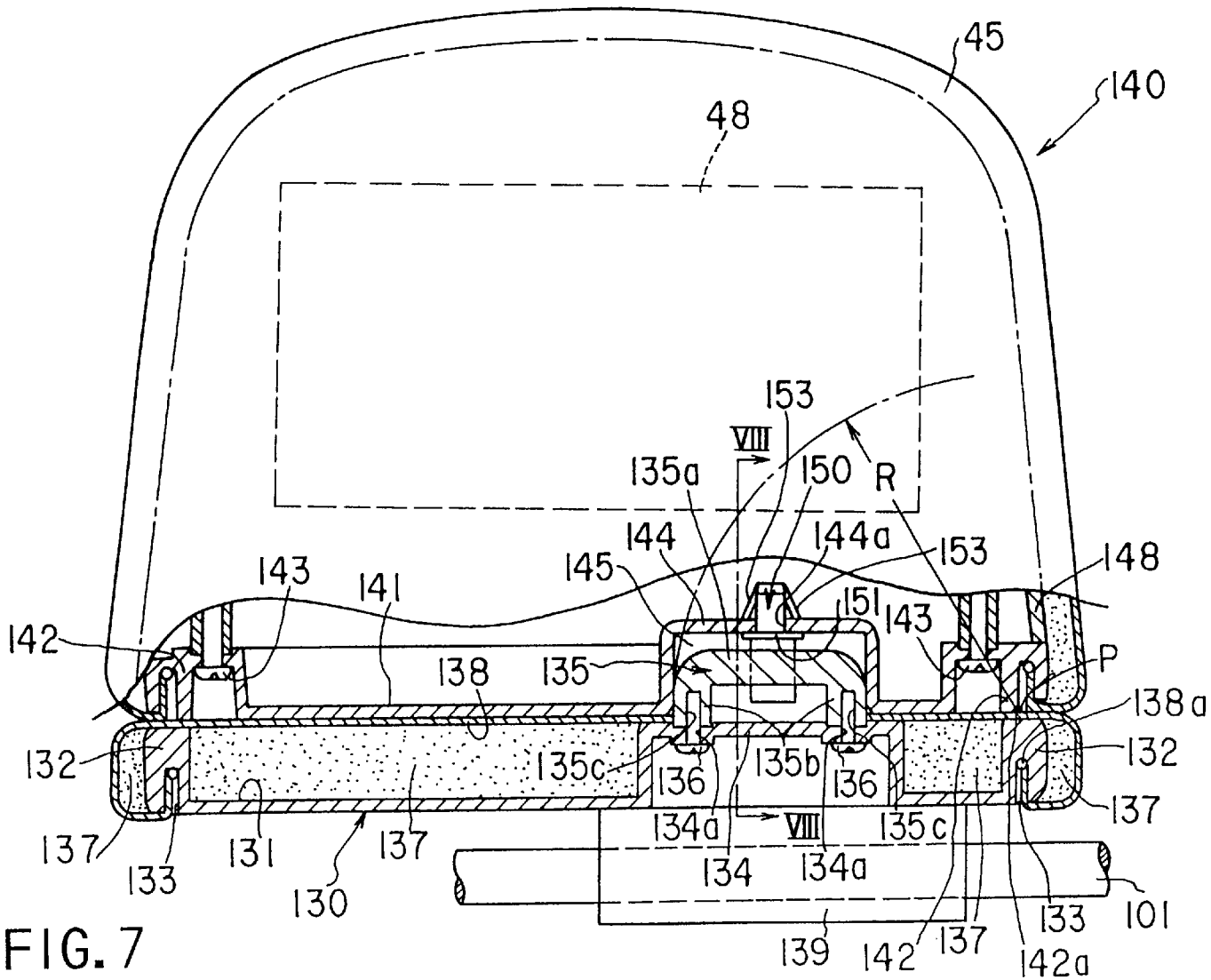
FIG. 7 is a side view schematically showing the chair type air massager shown in FIG. 6 in a state where a leg massage device is mounted to a leg supporting table, wherein a part of the leg massage device is cut away to show a connecting structure of both the leg massage device and the leg supporting table.
Figure 8:
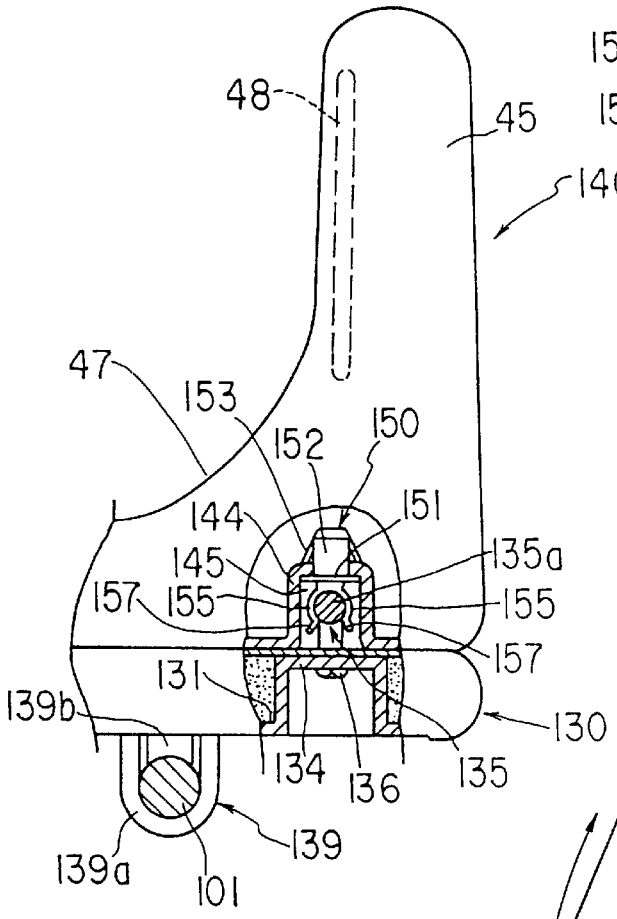
FIG. 8 is a front view schematically showing the chair type air massager shown in FIG. 6 in the state where the leg massage device is mounted to the leg supporting table, wherein parts of the leg massage device and the leg supporting table are cut away along a line VIII—VIII in FIG. 7 to show the connecting structure of both the leg massage device and the leg supporting table.

As shown in FIGS. 7 and 8, the leg supporting table 130 includes a base plate 131, connecting members 135 mounted to an upper surface of the base plate 131, and a sliding bearing 139 mounted to a lower surface of the base plate 131.

The base plate 131 has a substantially rectangular flat shape which is thin and long in right and left directions, and a peripheral wall 132 projecting upwards is formed on its periphery. A continuous groove 133 opened downwards in FIG. 7 is formed in the peripheral wall 132.

Mounting portions 134 are formed at laterally opposite ends on an upper surface of the base plate 131 in a back side of a center of the upper surface in its longitudinal direction. An upper surface of each of the mounting portions 134 is flat, and a pair of through holes 134*a* are formed in opposite ends of the upper surface in the longitudinal direction.

As shown in FIGS. 6 to 9, each of the connecting members 135 includes a coupling portion 135*a* (see FIGS. 8 and 9) having a circular cross section and extending straightly, and legs 135*b* which are bent from opposite ends of the connecting portion 135*a* substantially at a right angle. A screw hole 135*c* is formed in a tip end surface of each of the legs 135*b*.

When connecting members 135 are fixed to the mounting portions 134 of the base plate 131 respectively, the screw holes 135*c* in the tip end surfaces of the pair of legs 135*b* of each of the connecting members 135 are brought into alignment with the through holes 134*a* of each of the mounting portions 134, and screws 136 are threaded into the screw holes 135*c* through the through holes 134*a* from a lower side of the base plate 131.

In the connecting member 135, an upper half of an outer peripheral surface of the engaging portion 135*a* having the circular cross section functions as a guide surface for an object which slides on the upper half.

The leg massage device 140 is mounted on the connecting members 135. If a front end of the leg massage device 140 is lifted up, the leg massage device 140 mounted on the connecting members 135 is rotated upwards around its rear end, more particularly, around a rear end of an outer peripheral edge 142*a* of a peripheral wall 142 of a bottom plate 141 of the leg massage device 140. At that time, a front end surface of the leg 135*b* located forwards on each of the connecting members 135 (left side in FIG. 7) is formed into such an arc that the arc is slightly smaller than an arc (shown with an one-dot chain line in FIG. 7) having a radius R between a rotation center P and the leg 135*b* located forwards on each of the connecting members 135 (left side in FIG. 7).

As shown in FIG. 8, each of a pair of right and left sliding bearings 139 on the lower surface of the base plate 131 includes a first bearing member 139*a* having a U-shaped cross section and extending in the longitudinal direction, and a second bearing member 139*b* provided inside of the first bearing member 189*a*. The supporting rods 101 of the pair of supporting members 100 of the chair body 21 are slidably inserted into both the bearing members 139*a* and 139*b*. With this design, the leg supporting table 130 can move in the back and fourth directions on the supporting members 100 disposed in front of the seat 23 so that a distance between the leg supporting table 130 and the seat 23 can be adjusted.

After the pair of sliding bearings 139 of the leg supporting table 130 are mounted on the supporting rods 101 of the supporting member 100 of the chair body 21, fall-out preventing members (not shown) are fixed to tip ends of the supporting rods 101.

A cushion member 137, for example made of urethane foam, is mounted on the upper surface of the base plate 131. The cushion member 137 is covered with a cover 138. An outer peripheral edge of the cover 138 is folded into the continuous groove 133 of the peripheral wall 132 of the base plate 131 and then, the peripheral edge is fixed in the continuous groove 133 by a resilient string 138*a*.

Since the cushion member 137 is provided on the upper surface of the leg supporting table 130, the user sitting on the chair body 21 can put his or her calves on the leg supporting table 130 comfortably while the leg massage device 140 is removed from the upper surface of the leg supporting table 130.

Next, the leg massage device 140 will be explained.

As shown in FIG. 7, the leg massage device 140 includes a rectangular bottom plate 141 forming the base 44 and extending its long sides in the right and left directions. A peripheral wall 142 projecting upwards is formed on the peripheral edge of the base plate 141. The leg massage device 140 further includes a wall frame member 148 (FIG. 7) fixed to the peripheral wall 142 of the bottom plate 141 by screws 143. The wall frame member 148 provides a frame for the pair of side walls 45 of the leg massage device 140 and the center wall 46 between the pair of side walls 45. A lower end of an outer peripheral edge 142*a* of the peripheral wall 142 of the bottom plate 141 is in contact with an upper surface of the peripheral wall 132 of the base plate 131 of the leg supporting plate 130 through the cover 138 covering the base plate 131.

A pair of projecting portions 144 projecting upwards are formed opposite ends of the bottom plate 141 in the right and left directions in a backside of a center in the back and fourth directions of the bottom plate 141. Each of the projecting portions 144 is thin and long in the back and fourth directions. The size of a downward opened recess of each of the pair of projecting portions 144 in the back and fourth directions is set substantially equal to a distance between outer sides of base ends of outer peripheral surfaces of the pair of front and rear legs 135*b* of each of the pair of connecting members 135 provided on the upper surface of the leg supporting table 130.

When the leg massage device 140 is mounted on the upper surface of the leg supporting table 130 disposed in the horizontal in-use position, each of recesses 145 of the pair of projecting portions 144 of the bottom plate 141 of the leg massage device 140 are fitted on the both legs 135*b* of each of the pair of connecting members 135 of the leg supporting table 130. With this, a movement of the leg massage device 140 on the leg supporting table 130 in the back and fourth directions is restricted.

Further, since the front end portion of the outer peripheral surface of the front leg 135*b* of each of the pair of connecting members 135 is formed into the arc which is slightly smaller than the above-described arc having the radius S, each of the recesses 145 of the pair of projecting portions 144 of the bottom plate 141 of the leg massage device 140 can move upwards from both the legs 135*b* of each of the pair of connecting members 135 without interfering with both the legs 135*b* of each of the pair of connecting members 135 when the leg massage device 140 mounted on the connecting members 135 is rotated around its rear end, and more particularly, around the rear end of the outer peripheral edge 142*a* of the peripheral wall 142 of the bottom plate 141 of the leg massage device 140, as a rotation center P, so that the front end of the leg massage device 140 can be lifted upwards.

A through hole 144*a* is formed in upper wall of each of the pair of projecting portions 144 of the bottom plate 141 of the leg massage device 140.

Next, a pair of engaging members 150 mounted in the recesses 145 of the pair of projecting portions 144 of the bottom plate 141 of the leg massage device 140 will be explained.

Figure 9:
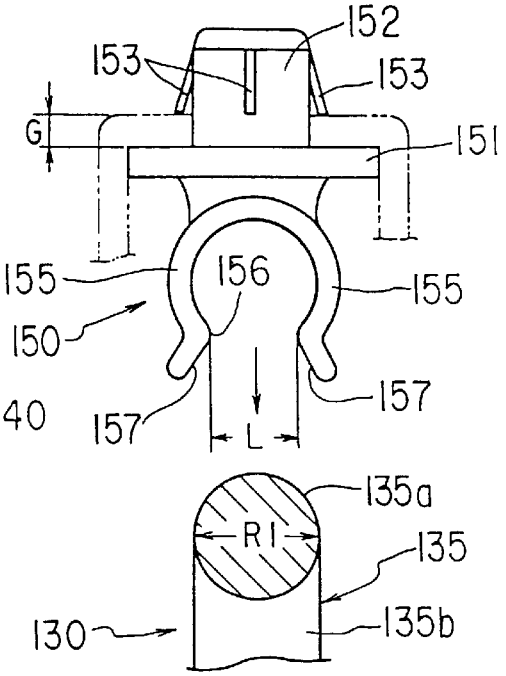
FIG. 9 is an enlarged front view schematically showing the connecting structure shown in FIGS. 7 and 8 in a state where the connecting structure is disconnected.
Figure 10:
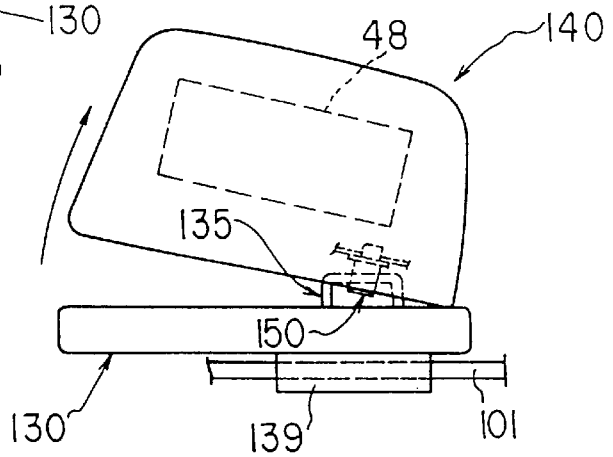
FIG. 10 is a side view schematically showing an operation of the leg massage device to the leg supporting table to disconnect the connecting structure in the chair type air massager shown in FIG. 6.
Figure 11:
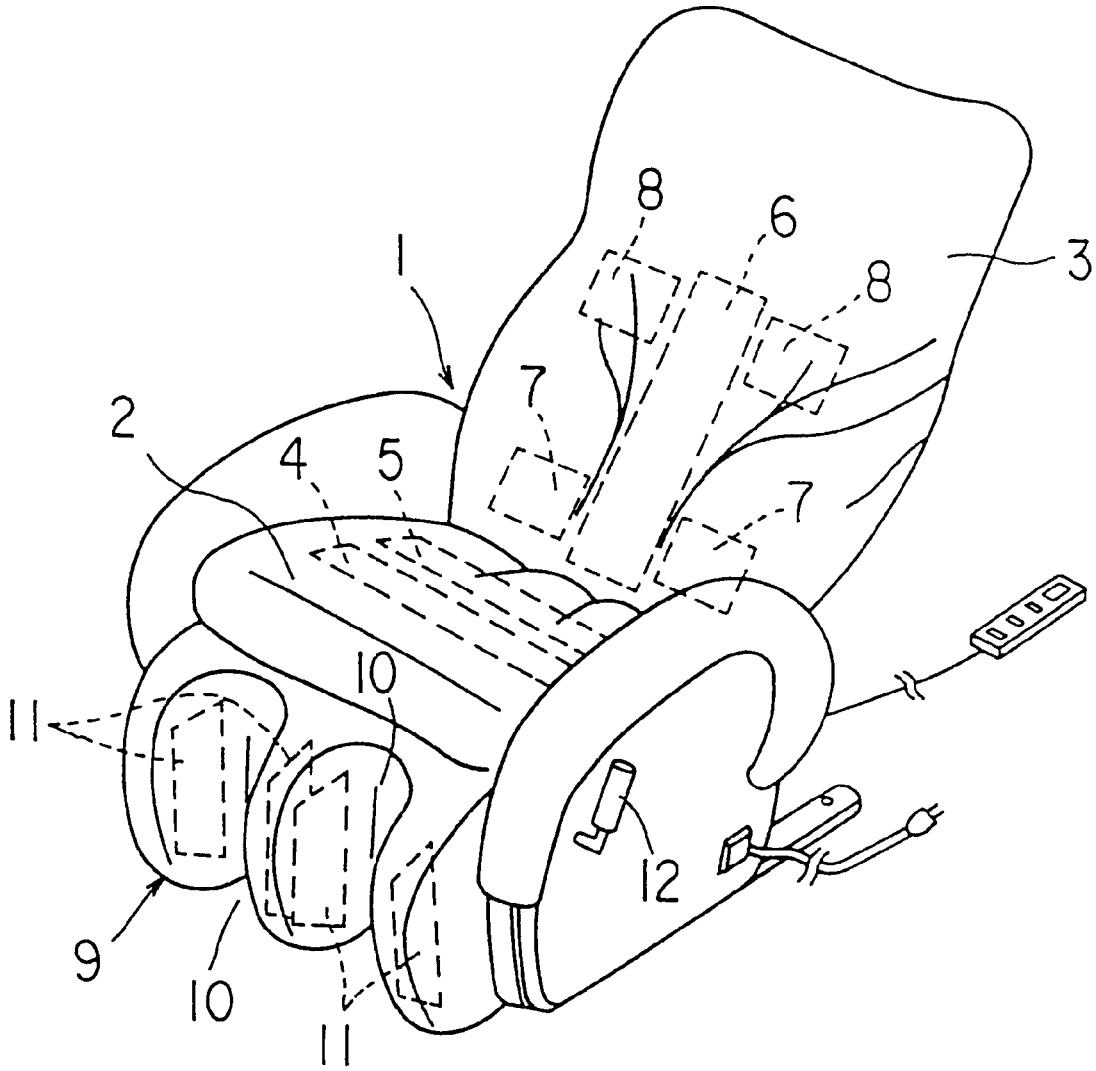
FIG. 11 is a schematic perspective view of a conventional chair type air massager.

As shown in FIGS. 7 to 9, each of the pair of engaging members 150 includes a base plate 151 having a substantially square flat shape, a fitting shaft 152 provided on an upper surface of the base plate 151, and a pair of arc shaped resilient engaging pieces 155 projecting downwards from a lower surface of the base plate 151.

A plurality of engaging projections 153 are provided on an outer peripheral surface of the fitting shaft 152. A predetermined gap G is provided between a lower end of each of the plurality of resilient engaging projections 153 and the upper surface of the base plate 151. The maximum outer diameter of the plurality of the resilient engaging projections 153 around the fitting shaft 152 is set greater than the inner diameter of the through hole 144*a* of the upper wall of each of the pair of projecting portions 144. An outer diameter of the outer peripheral surface of the fitting shaft 152 is set slightly smaller than a diameter of the through hole 144*a*.

Mounting of the engaging members 150 into the pair of projecting portions 144 of the bottom plate 141 of the leg massage device 140 is performed by forcibly pushing the fitting shafts 152 of the engaging members 150 into the through holes 144*a* of the projecting portions 144. More particularly, by this pushing operation, the diameter of the lower ends of the plurality of resilient engaging projections 153 on each of the fitting shafts 152 is resiliently reduced by the inner peripheral surface of each of the through holes 144*a* and thus, each of the fitting shafts 152 are allowed to be inserted into each of the through holes 144*a*. After lower ends of the plurality of resilient engaging projections 153 passed through each of the through holes 144*a*, as shown in FIGS. 7 and 8, the fitting shaft 152 sandwiches a portion of each of the through holes 144*a* corresponding thereto by the plurality of resilient engaging projections 153 and the base plate 151 in the upper wall of each of the projecting portions 144 so that mounting of the engaging members 150 to the corresponding through holes 144*a* are performed.

Each of opposed inner peripheral surfaces of each of the pair of engaging pieces 155 is formed into an arc surface having substantially the same diameter as a diameter R1 of an outer peripheral surface of the coupling portion 135*a* of each of the connecting members 135. A width L of an opening 156 between tip ends of the pair of engaging pieces 155 is smaller than the diameter R1 of the outer peripheral surface of the coupling portion 135*a* of each of the connecting members 135. A pair of insertion guide projections extending to separate away from each other as they extending downwards from the tip ends of the pair of engaging pieces 155, and opposed inner surfaces of the pair of insertion guide projections function as guided inner surfaces 157.

When the recesses 145 of the pair of projecting portions 144 of the base plate 141 of the leg massage device 140 are put on the pair of connecting members 135 of the leg supporting table 130 disposed in its horizontal in-use position, the pair of engaging pieces 155 of each of the engaging members 150 in the recesses 145 are first brought into abutment against the guide surface 135*a* of the upper half of the outer peripheral surface of the coupling portion 135*a* of each of the connecting members 135. Next, the guided inner surfaces 157 of the pair of engaging pieces 155 move downwards along the guiding surface 135*a* of the upper half of the outer peripheral surface of the coupling portion 135*a* of each of the connecting members 135, so that the opening 156 between the pair of engaging pieces 155 is resiliently spread out, and the coupling portion 135*a* of the connecting member 135 corresponding to the opening 156 can be inserted into the arc shaped space between the pair of engaging pieces 155 through the opening 156. During this time, the pair of engaging pieces 155 approach each other by their own resilient force along a lower half of the outer peripheral surface of the coupling portion 135*a* of each of the connecting members 135, thereby pushing the inner surfaces of the pair of engaging pieces 155 against the outer peripheral surface of the coupling portion 135*a* of each of the connecting members 135. As a result, the pair of engaging pieces 155 engage the coupling portion 135*a* of each of the connecting members 135. Eventually, the leg massage device 140 is detachably fixed to a predetermined position in front of the seat 23 of the chair body 21 on the leg supporting table 130.

That is, a combination of the guided inner surfaces 157 of the pair of engaging pieces 155 of each of the engaging members 150 with the guide surface of the upper half of each of the outer peripheral surface of the coupling portion 135*a* of each of the connecting members 135 facilitates the mounting operation of the leg massage device 140 to the predetermined position on the leg supporting table 130 by a simple operation in which the recesses 145 of the pair of projecting portions 144 of the bottom plate 141 of the leg massage device 140 are put on the pair of coupling members 135 of the leg supporting table 130 disposed in the horizontal in-use position and then, the leg massage device 140 is pushed toward the leg supporting table 130.

The leg massage device 140 mounted to the leg supporting table 130 disposed in the horizontal in-use position, together with the leg supporting table 130, can be moved in the back and fourth directions in front of the seat 23 by moving the leg supporting table 130 in the back and fourth directions along the supporting member 100 disposed in front of the seat 23 of the chair body 21. Therefore, the user sitting on the seat can finely adjust the position of the leg massage device 140 in the back and fourth directions in front of the seat 23 so that desired portions of the legs of the sitting user are air massaged by the leg massage bags 48 of the pair of leg accommodating grooves 47 while the user put his or her calves into the pair of leg accommodating grooves 47 of the leg massage device 140.

When the leg massage device 140 is removed from the predetermined position on the leg supporting table 130, the leg massage device 140 is rotated upwards around its rear end as a rotation center P, more particularly, around the rear end of the outer peripheral edge 142*a* of the peripheral wall 142 of the bottom plate 141 of the leg massage device 140, on the leg supporting table 130, such that the front end of the leg massage device 140 can be lifted upwards.

The pair of right and left connecting members 135 of the leg supporting table 130 are provided in the back side of the center portion of the base plate 131 of the leg supporting table 130 in the back and fourth directions, and the pair of right and left engaging members 150 of the leg massage device 140 are also mounted in back side of the center portion on the bottom plate 141 of the leg massage device 140 in the back and fourth directions. Further, the leg massage device 140 is rotated around its rear end as the rotation center P. Therefore, force upwardly applied to the front end of the leg massage device 140 is applied, as greater upwards force, to the pair of right and left engaging members 150 of the leg massage device 140 by the lever action of the bottom plate 141 of the leg massage device 140. This facilitates the operation for releasing the engagement of the pair of right and left engaging members 150 of the leg massage device 140 with the pair of right and left connecting members 135 of the leg supporting member 130, i.e., the removing operation of the leg massage device 140 from the leg supporting member 130.

In the above-described second embodiment, although the positions of the pair of engaging members 155 on the leg massage device 140 in the back and fourth directions are described as being in the back side of the center portion of the leg massage device 140 in the back and fourth directions, such positions can be set in the front side of the center portion. In the latter case, in order to disengage the pair of right and left engaging members 150 of the leg massage device 140 from the pair of right and left connecting members 135 of the leg supporting table 130, the leg massage device 140 must be rotated around its front end as the rotation center P such that its rear end moves upwards, but like the former case, the engagement releasing operation can be facilitated. However, in the latter case, since a distance between the pivot shafts 106 which mount the supporting member 100 supporting the leg supporting table 130 to the body frame 22, and the position of the rotation center of the leg massage device 140, force applied to the pivot shafts 106 of the supporting member 100 wherever the force is applied to the leg massage device 140 to remove the leg massage device 140 from the leg supporting table 130, and there is a possibility that the probability of damaging the pivot shafts 106 increase.

In the chair type air massager of the second embodiment also, as in the first embodiment, the user can designate a desirable massage mode by the remote controller 57 and enjoy the air massage. Further, since the leg massage device 140 is detachable from the chair body 21, i.e., from the leg supporting table 130, the massager can be used as in the same using modes as the first and second using modes in the first embodiment.

When the leg massage device 140 is not used, the leg massage device 140 can be stored in the storing region S under the seat 23 as in the first embodiment.

Although the leg supporting table 130 is mounted on the supporting member 100 such that the leg supporting table 130 can move in the back and fourth directions in the second embodiment, it is possible to mount the leg supporting table 130 on the supporting member 100 such that the leg supporting table 130 can not move in the back and fourth directions.

Further, in the second embodiment, the supporting member 100 is vertically rotatably mounted to the body frame 22 by the pivot shafts 106, but it is also possible to construct such that the supporting member 100 moves in the back and fourth directions with respect to the body frame 22 so that the supporting member 100 moves between a position under the seat 23 and a position in front of the seat 23.

As apparent from the above description, the chair type air massager according to the present invention is suitably used in a chair type air massager including a leg massage device.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A chair type air massager comprising:

a chair body including a seat, a back rest and a plurality of massage bags embedded therein;

a leg massage device including at least one leg accommodating groove and at least one massage bag provided in correspondence to the at least one leg accommodating groove, said leg massage device being capable of moving between a first position where the leg massage device is disposed in front of the seat and is connected to the chair body and a second position where the leg massage device is separated from the chair body, and said leg accommodating groove being capable of accommodating therein at least one leg of a user sitting on the seat of the chair body when the leg massage device is disposed in the first position and being capable of accommodating therein at least one leg of a user who is not sitting on the seat of the chair body when the leg massage device is in the second position;

a compressed air supply/discharge device that supplies and discharges compressed air to and from the plurality of massage bags of the chair body and the at least one massage bag of the leg massage device, said air supply/discharge device being provided in the chair body and having a connector disposed on an outer surface of the chair body;

a high pressurized air transmitting tube having a first end detachably connected to the connector of the air supply/discharge device and a second end connected to at least one of the at least one massage bag of the leg massage device;

a supporting member which is movable between a projecting position where the supporting member is projected forward from the seat and a retracted position where the supporting member is retracted under the seat;

a leg supporting table provided on the supporting member;

a connecting member provided on the leg supporting table; and an engaging member provided on the leg massage device at a position separated from a center position of the leg massage device in a direction along which the leg accommodating groove extends;

wherein said engaging member is detachably engageable with the connecting member while the supporting member is disposed in the projecting position to thereby dispose the leg massage device in the first position; and wherein when the leg massage device is moved on the connecting member to rotate around an end of the leg massage device in the direction along which the leg accommodating grove extends, engagement of the engaging member with the connecting member is released.

2. The chair type air massager according to claim 1, wherein the connecting member includes a guide surface, and the engaging member includes a guided surface whose movement is guided along the guide surface of the connecting member when the engaging member engages with the connecting member.

3. The chair type air massager according to claim 1, wherein the leg supporting table is supported on the supporting member to be movable in a back and forth direction with respect to the seat.

* * * * *